US005285583A

United States Patent [19]

Aleven

[11] Patent Number: 5,285,583

[45] Date of Patent: Feb. 15, 1994

[54] PUNCTURE RESISTANT INSOLE FOR SAFETY FOOTWEAR

[75] Inventor: Albertus A. W. Aleven, Markdale, Canada

[73] Assignee: Terra Nova Shoes Ltd., Harbour Grace, Canada

[21] Appl. No.: 956,978

[22] Filed: Oct. 6, 1992

Related U.S. Application Data

[63] Continuation-in-part of Ser. No. 636,591, Jan. 2, 1991, abandoned.

[51] Int. Cl.[5] ..... A43B 13/38

[52] U.S. Cl. ..... 36/44; 36/43; 36/73

[58] Field of Search ..... 36/43, 44, 76 C, 73, 36/75 R, 85, 87, 96, 107, 108, 182, 140, 154, 178, 181

[56] References Cited

U.S. PATENT DOCUMENTS

| | | | |
|---|---|---|---|
| 1,978,549 | 10/1934 | Muir | 36/44 |
| 2,074,444 | 3/1937 | Warren | 36/44 |
| 2,644,250 | 7/1953 | Ciaio | 36/44 |
| 2,803,895 | 8/1957 | Frieder et al. | 36/73 |
| 2,808,663 | 10/1957 | Frieder et al. | 36/44 |
| 3,233,348 | 2/1966 | Gilkerson | 36/44 |
| 3,253,600 | 5/1966 | Scholl | 36/154 |
| 3,561,141 | 2/1971 | Brown | 36/44 |
| 3,825,017 | 7/1974 | Scrima | 36/44 |
| 4,049,595 | 9/1977 | Dominguez | 36/32 R |
| 4,296,053 | 10/1981 | Doerer et al. | 36/44 |
| 4,522,777 | 6/1985 | Peterson | 36/154 |
| 4,782,605 | 11/1988 | Chapnick | 36/44 |
| 5,123,180 | 6/1992 | Nannig et al. | 36/76 C |

*Primary Examiner*—Paul T. Sewell
*Assistant Examiner*—Thomas P. Hillard
*Attorney, Agent, or Firm*—Ridout & Maybee

[57] ABSTRACT

A protective insole for use in safety footwear comprising a protective layer composed of plastic and including a flexible forepart portion having an insole board bonded to its bottom surface and a fabric liner bonded to its top surface during the process of molding the protective plastic layer. A fabric mesh may be embedded in the plastic layer for reinforcement. A further embodiment provides a steel forepart plate anchored to a plastic shank and heel about the region of greatest flexure.

2 Claims, 5 Drawing Sheets

PUNCTURE RESISTANT INSOLE FOR SAFETY FOOTWEAR

This is a continuation-in-part of application Ser. No. 07/636,591 filed Jan. 2, 1991, now abandoned.

FIELD OF THE INVENTION

This invention relates to safety footwear. In particular, this invention relates to an improved protective insole for use in safety footwear.

BACKGROUND OF THE INVENTION

Safety footwear is used, and often required, in many industries, for example the construction industry. Such safety footwear may incorporate a protective insole or a protective toe cap, or both. A typical example would be a safety boot, which example will be used throughout this specification although the structures and principles described are equally applicable to shoes and other types of footwear.

In a typical safety boot a steel sole plate overlays a large portion of the outsole of the boot to prevent penetration of the sole by sharp objects such as nails and the like. A conventional sole plate, comprising a unitary forepart plate, shank and heel, is formed from steel. In a conventional construction, the sole plate can be cemented to the upper which has been formed over a last (lasted); it can be riveted to the insole at the rear and floated into the outsole material; or it can be cemented to the insole board prior to lasting.

These conventional constructions provide a number of disadvantages. Attachment of the protective plate, insole board and sockliner, being three separate components, requires three separate operations. Typically the plate is attached to the insole board by one of the methods described above, the insole board is attached to the upper, and the sockliner is inserted after construction of the boot is otherwise complete.

Moreover, where the sole plate is cemented to the lasted upper or floated into the outsole material, injection molding of the outsole does not result in complete filling, leading to a void in the area under the plate resulting in a soft sole.

It is desirable in such a construction that the insole board be affixed directly to the outsole at the periphery, to prevent separation, and thus the sole plate is cut smaller than both the insole board and the outsole, leaving a margin around which the latter can be tacked or cemented together. The smaller sole plate provides a margin for attachment of the outsole to the upper. For this reason a conventional sole plate covers only approximately 70% to 80% of the sole of the boot, leaving a margin vulnerable to penetration.

The sole plate should be rigid in the shank and heel regions of the sole, since these do not flex during normal use. On the other hand, considerable flexing occurs during normal use along a line transverse to the foot at approximately the ball of the foot. Conventional steel sole plates encounter problems with cracking along the region of flexure due to work hardening of the steel, which decreases the protective ability of the sole plate and can deform the contour of the sole. Cracks can open in the plate and protection is lost in these areas.

The present invention overcomes these disadvantages by providing an integral protective sole comprising a protective layer sandwiched between an insole board and a fabric liner. In both preferred embodiments described herein the protective layer is formed by injection of molten plastic between the sockliner and the insole board, in the process bonding the sockliner and insole board to opposite sides of the protective plastic layer as an integral unit and thus avoiding the need for the additional steps of cementing and tacking to affix the separate components as described above.

The use of plastic injection molding to form the protective layer further permits both the protective layer and the insole board to form to the desired shape under heat and pressure, in a single step, and the shape of the insole board is thereafter maintained by the hardened plastic.

Since the insole board forms the lower layer of the insole, the outsole can be bonded directly to the insole board, obviating the need to leave a margin around the protective plate and allowing for complete filling of the outsole when molded.

The plastic layer according to this design provides full coverage over the sole, thus avoiding an unprotected margin which is vulnerable to penetration by sharp objects. Furthermore, the use of plastic as a protective layer, while equally effective to steel in puncture resistance, results in greater flexibility and durability particularly in critical regions such as along the ball of the foot.

The use of a plastic protective layer, dispensing with the need for a thick and rigid steel plate in the heel and shank regions of the sole, results in a much lighter protective insole unit than a conventional insole composed of steel sole plate, insole board, sockliner, tacks and assorted cements.

The present invention thus provides a protective insole for safety footwear comprising a protective layer composed of plastic and including a flexible forepart portion, an insole board bonded by the plastic to a bottom surface of the plastic, and a fabric liner bonded by the plastic to a top surface of the plastic.

The present invention further provides a method of constructing a protective insole for safety footwear comprising the steps of cutting a fabric liner and an insole board to the desired shape, placing the fabric liner and the insole board into a mold allowing for a clearance between the liner and the insole board, and injecting molten plastic through an injection port in the insole board to fill the clearance between the liner and the insole board, whereby upon hardening of the plastic the liner and insole board are bonded to the plastic to form an integral protective insole.

BRIEF DESCRIPTION OF THE DRAWINGS

In drawings which illustrate by way of example only a preferred embodiment of the invention.

DETAILED DESCRIPTION OF THE INVENTION

Figure 1:
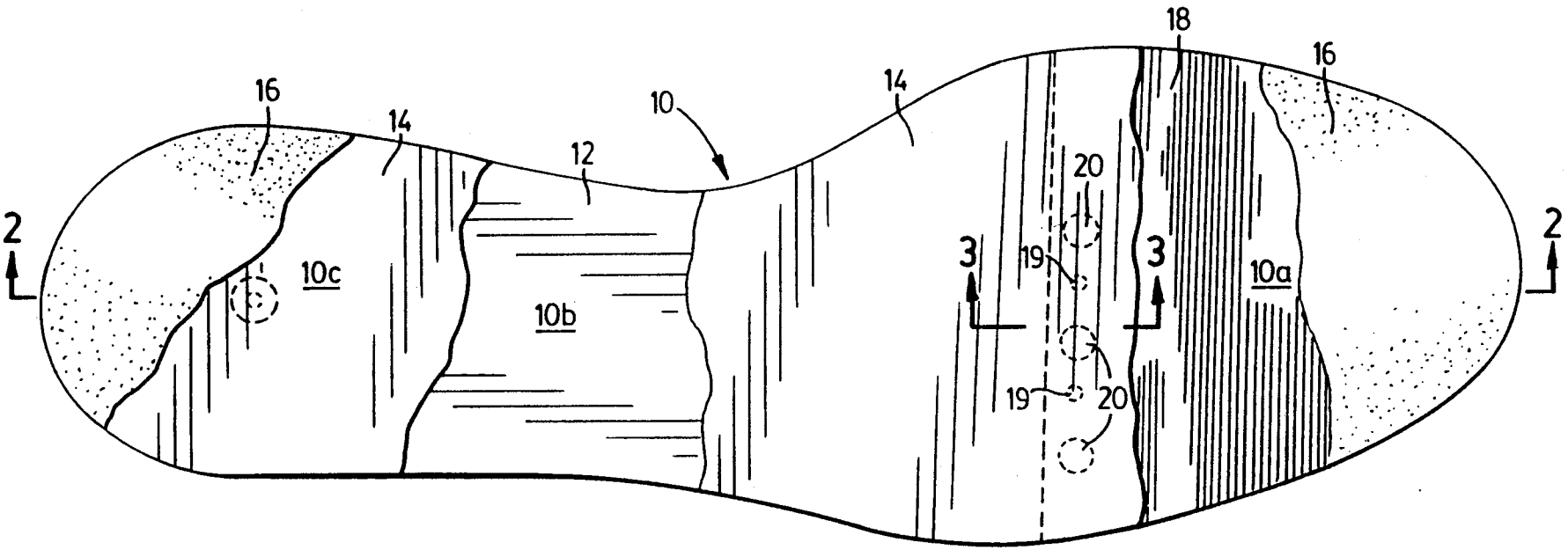
FIG. 1 is a top plan view, partially cut away, of a protective insole embodying a first preferred embodiment of the invention.
Figure 2:
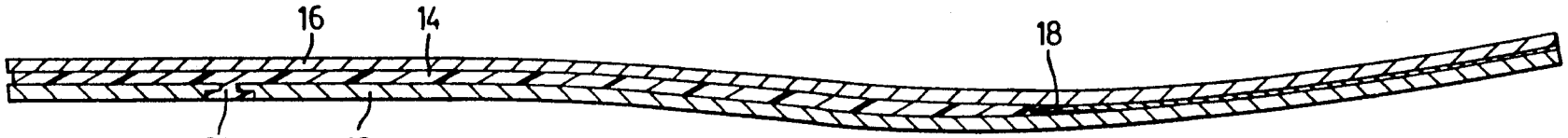
FIG. 2 is a cross-section of the embodiment illustrated in FIG. 1.
Figure 3:
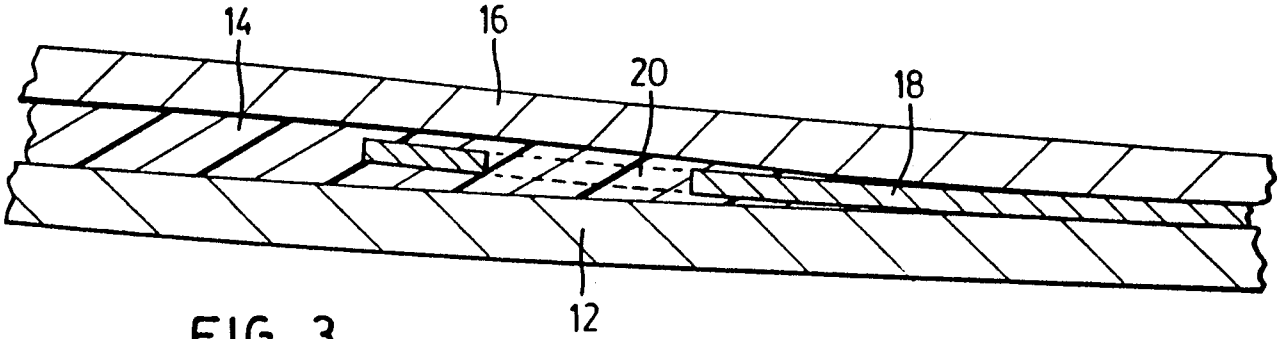
FIG. 3 is a partial enlarged section of the embodiment illustrated in FIG. 1 showing details of the junction between the shank and the forepart plate.

FIGS. 1-3 illustrate a first preferred embodiment of this invention. The protective insole 10, having a forepart 10a, a shank 10b and a heel 10c, comprises a layer of insole board 12, treated with a fungicide or other conventional treatment, cut or die stamped in the desired configuration and having a profile generally compatible with the contour of the sole of the human foot, as illustrated in FIG. 2.

A plastic layer 14, formed by injection molding, forms the heel and shank of the protective layer and during the molding process bonds the insole board 12 to one face, and a liner 16 to the opposite face, of the plastic over the heel 10c and shank 10b portions of the insole 10. The plastic should have a high impact strength, but must be sufficiently flexible to prevent breaking or shattering due to constant flexing.

The preferred plastic is a polyamide with an Izod Impact Strength ranging from approximately 16.8 ft-lb/in to 20.6 ft-lb/in at 73° F. and from 2.1 ft-lb/in to 2.7 ft-lb/in at −40° F. for a thickness of 0.125 inches; and a flexural stress ranging from approximately 10,400 lb/in$^2$ to 12,800 lb/in$^2$ as molded and from approximately 3,250 lb/in$^2$ to 3,950 lb/in$^2$ conditioned. An example of such a plastic is BAYER DURATHAN BC402 (Trademark), which has an Izod Impact Strength of 18.7 ft-lb/in at 73° F. and 2.4 ft-lb/in at −40° F. for a thickness of 0.125 inches and a flexural stress of 11,600 lb/in$^2$ as molded and 3,600 lb/in$^2$ conditioned. A ⅛ inch thickness of this material will pass the Canadian Standards Association Z195 Protective Sole Test (March 1984, Section 4.2.1).

A protective forepart plate 18 congruent with the forepart 10a of the insole 10, composed of stainless steel ranging in thickness from 0.020 to 0.028 inches, and preferably 0.024 inches, is anchored to the plastic layer 14 during the molding process at locking holes 20. The plastic 14 preferably overlaps both the top and bottom faces of the forepart plate 18 along its rear margin for maximum strength, tapering down forwardly of the locking holes 20, as shown in FIG. 3. The junction between the shank and the forepart plate 18 (shown in phantom lines in FIG. 1) should be located in the region of greatest flexure, i.e. slightly forwardly of the ball of the foot, so that the plastic layer 14 absorbs most of the stress due to flexing of the sole in use.

Figure 6:
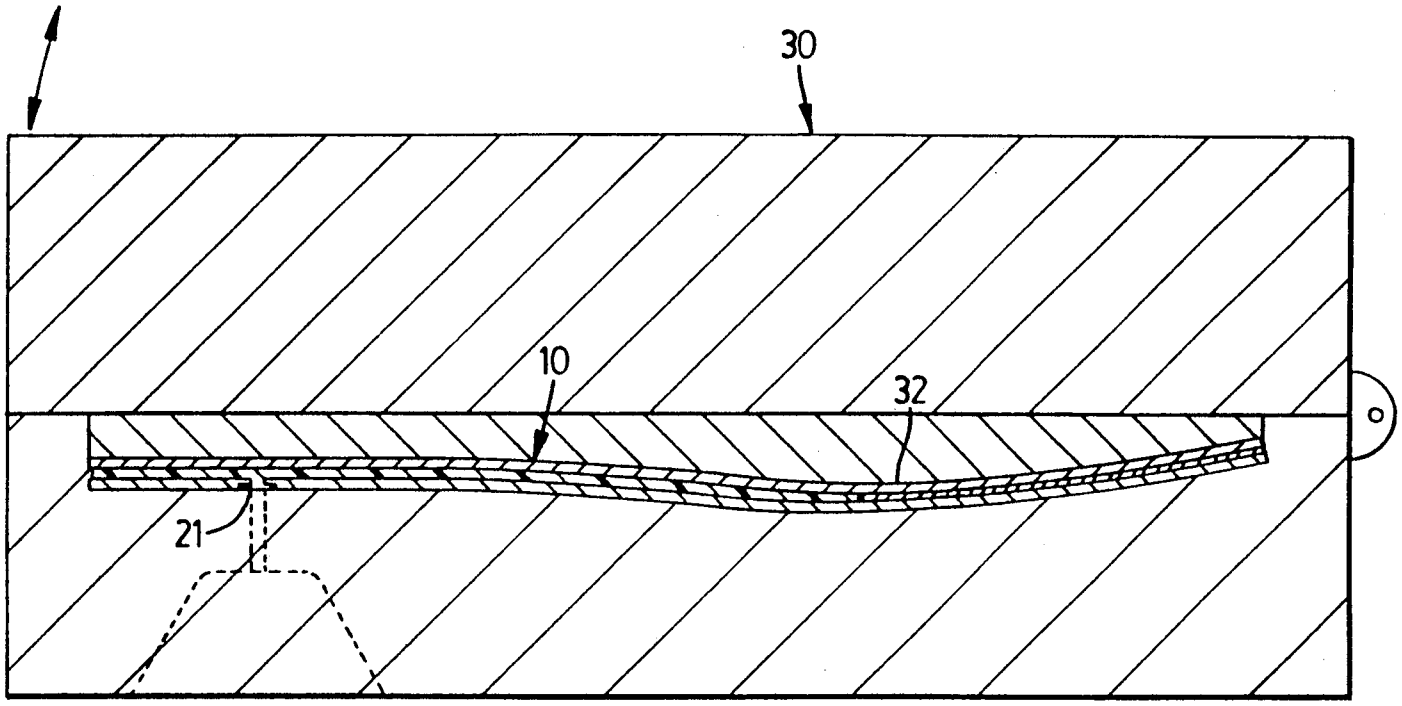
FIG. 6 is a cross-sectional view of a mold for constructing the embodiments of FIGS. 1 and 4.

To produce the embodiment illustrated in FIGS. 1-3, the insole board 12, forepart plate 18 and liner 16 are positioned in a mold 30, as illustrated in FIG. 6, and molten plastic is injected through an injection port 34 in the mold 30 and thus through an injection port 21 located through the heel portion of the insole board 12. The forepart plate 18 includes holes 19 for locator pins (not shown) on the mold 30, to anchor it during the molding process.

The molten plastic forces the insole board 12 and liner 16 apart, and thus fills a clearance of the desired thickness between the insole board 12 and liner 16, determined by the configuration of the mold 30, throughout the heel 10c and shank 10b regions and extending to a nip 32 impinging on the forepart plate 18 slightly forwardly of the locking holes 20. A generally uniform thickness ranging from ⅛ to 3/16 inches is preferred, tapering down toward the nip 32 as best illustrated in FIG. 3.

Figure 7:
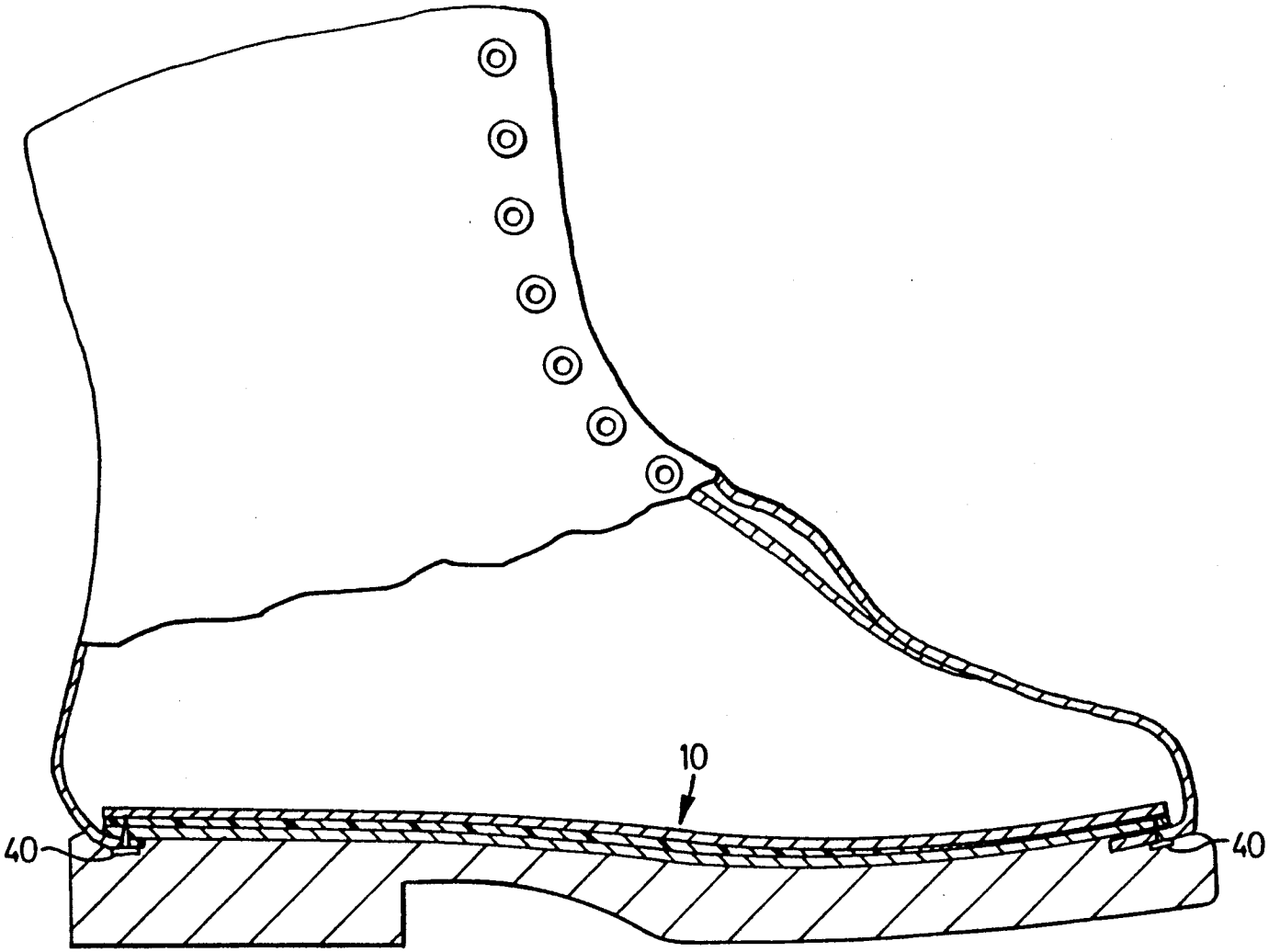
FIG. 7 is a cross-sectional view of a safety boot embodying the first embodiment of the invention.

The insole board 12 and liner 16 adhere to the molten plastic as it hardens The plastic also flows through the locking holes 20 in the steel forepart plate 18, and preferably overlaps both faces along the rear margin of the plate 18, thus anchoring the forepart plate 18 to the shank portion 10b of the protective plastic layer 14. The steel forepart plate 18 may also be tacked to the outsole for additional strength, as illustrated at 40 in FIG. 7.

Figure 4:
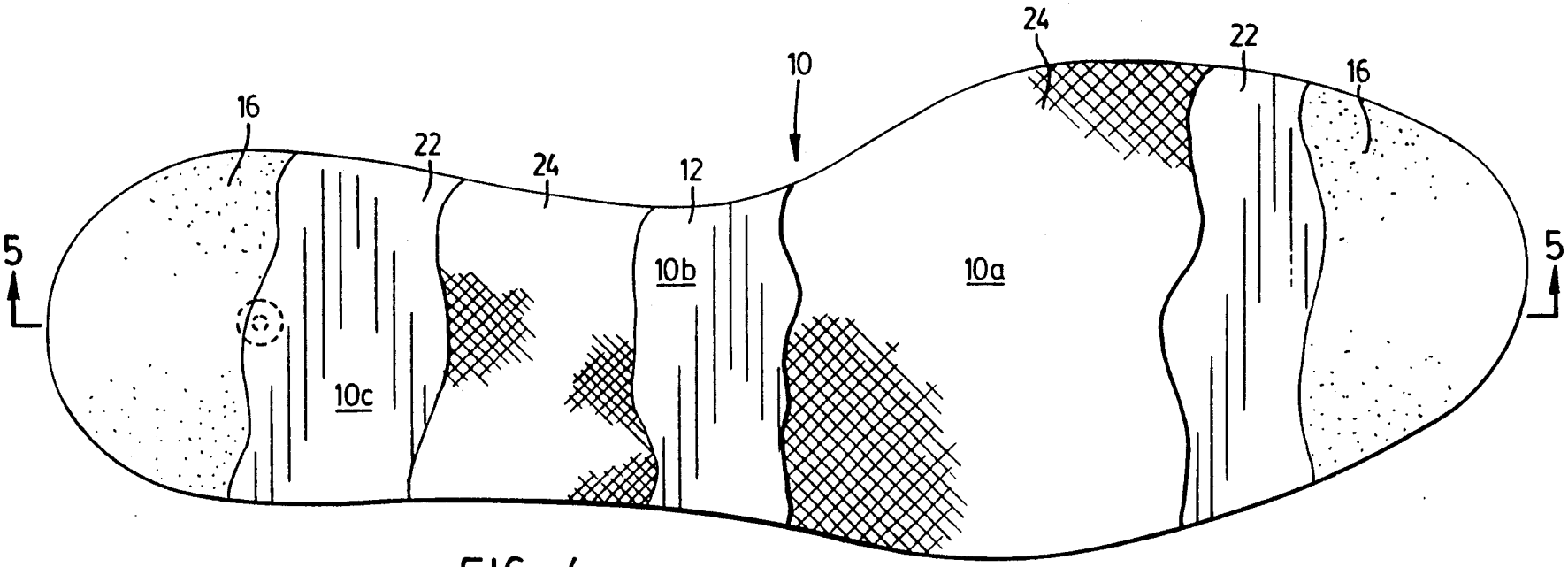
FIG. 4 is a top plan view, partially cut away, of a protective insole embodying a second preferred embodiment of the invention.
Figure 5:
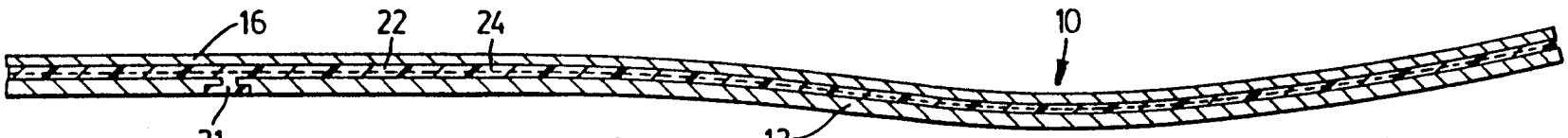
FIG. 5 is a cross-sectional view of the embodiment illustrated in FIG. 4.

A second preferred embodiment of the invention is illustrated in FIGS. 4 and 5, in which the forepart plate 18 is omitted and the molten plastic is injected throughout not only the heel 10c and shank 10b but also the forepart region 10a of the insole, forming a unitary protective plastic layer 22 extending throughout the entire insole 10. Preferably the forepart region 10a of the plastic layer 22 is relatively thinner than the heel 10c and shank 10b regions, ranging in thickness from 3/32 to ⅛ inches, to allow for greater flexibility at the critical region near the ball of the foot. This relative thickness is also determined by the configuration of the mold 30, which is similar to that used for the first embodiment but without the locator pins and the nip 32.

The plastic layer 22 may be reinforced with a fabric mesh 24 such as ballistic nylon, as illustrated in FIGS. 4 and 5, cut to the desired shape, by introducing the mesh 24 into the mold 30 between the insole board 12 and liner 16 prior to injection of plastic. The porosity of the mesh 24 permits the molten plastic to flow through to the liner 16 during the injection molding process.

When embedded in the hardened plastic 22 the mesh 24 facilitates resistance to penetration by sharp objects because the plastic 22 prevents displacement of the threads of the mesh 24. The mesh 24 also provides flexible reinforcement for the plastic 22 to assist in preventing cracking and separation.

Both preferred embodiments of the integral protective insole 10 may be bonded to the outsole by conventional means, such as tacking or cementing, and the upper may be subsequently attached by conventional means.

The foregoing description of the invention describes preferred embodiments only. Modifications and adaptations of the invention will be obvious to those skilled in the art, and all such modifications and adaptations as fall within the scope of the claims are intended to be included in this invention.

We claim:

1. A protective insole for safety footwear comprising
   an integral protective layer composed of plastic comprising a polyamide substantially conforming in size and shape to a sole area of the footwear and including a heel portion and a relatively more flexible forepart portion,
   an insole board bonded by the plastic to a bottom surface of the plastic over substantially the entire area of the protective layer, and
   a fabric layer bonded by the plastic to a top surface of the plastic over substantially the entire area of the protective layer,
   wherein the plastic has an Izod Impact Strength ranging from approximately 16.8 ft-lb/in to 20.6 ft-lb/in at 73° F., and from approximately 2.1 ft-lb/in to 2.7 ft-lb/in at −40° F., for a thickness of 0.125 inches; and a flexural stress ranging from approximately 10,400 lb/in$^2$ to 12,800 lb/in$^2$ as molded and from approximately 3,250 lb/in$^2$ to 3,950 lb/in$^2$ conditioned.

2. A protective insole as defined in claim 1, wherein the plastic has a flexural stress of 11,600 lb/in$^2$ as molded and 3,600 lb/in$^2$ conditioned.

* * * * *